United States Patent [19]

Sturwold

[11] 4,396,515

[45] Aug. 2, 1983

[54] COATING OIL COMPOSITIONS

[75] Inventor: Robert J. Sturwold, Cincinnati, Ohio

[73] Assignee: Cincinnati Vulcan Company, Cincinnati, Ohio

[21] Appl. No.: 281,597

[22] Filed: Jul. 9, 1981

Related U.S. Application Data

[63] Continuation-in-part of Ser. No. 134,887, Mar. 28, 1980, abandoned.

[51] Int. Cl.[3] ..... C10M 1/40

[52] U.S. Cl. ..... 252/33.2; 252/56 R; 252/389 R

[58] Field of Search ..... 252/33, 33.2, 33.4, 252/56 R, 389 R; 72/42; 427/327; 428/457

[56] References Cited

U.S. PATENT DOCUMENTS 2,551,124 5/1951 Helmore ..... 252/33

3,857,789 12/1974 Krupen et al. ..... 252/33.4

*Primary Examiner*—Jacqueline V. Howard

[57] ABSTRACT

Useful oil compositions for coating ferrous and non-ferrous metals are provided. The coating oils are blends of a petroleum sulfonate, polymeric fatty acid and hydrocarbon oil.

15 Claims, No Drawings

COATING OIL COMPOSITIONS

CROSS-REFERENCE TO RELATED APPLICATION

This is a continuation-in-part of my copending application Ser. No. 134,887, filed Mar. 28, 1980, now abandoned.

BACKGROUND OF THE INVENTION

The need to protect metal surfaces, particularly the surfaces of ferrous metals, during storage between operations is recognized throughout the industry. It is not uncommon for metal coils, for example, to be stored for prolonged periods prior to the next working operation, which can be stamping or another rolling operation to further reduce the thickness of the sheet and/or impart the desired metallurgical properties to the metal. Very often the metal coils are stored in areas adjacent to pickling lines and as a result the metal is exposed to the corrosive action of acid vapors. To prevent, or at least minimize, deterioration of the metal surfaces protective coatings are commonly applied.

Numerous types of protective coatings are known and have been reported in the literature to protect against rusting. Typically these products form a continuous hydrophobic barrier on the metal surface, however, while they may be impervious to moisture they are not totally effective in the presence of corrosive vapors. Accordingly, it is necessary to formulate products which are specifically designed to withstand the rigorous conditions encountered when substantial concentrations of acidic vapors are present.

U.S. Pat. No. 4,166,151, for example, discloses "waxy" ester compositions useful for protecting metal surfaces from acidic vapor which are derived from $C_{10-25}$ aliphatic carboxylic acids and $C_{15-40}$ aliphatic alcohols. These ester products are applied to the metal in an inert, volatile hydrocarbon, however, many of the waxy esters have limited solubility in the commonly used hydrocarbon carriers and must be applied as dispersions, which can present problems. For example, if the dispersions are allowed to stand, agitation is necessary prior to use and may even be required throughout the application period, depending on the type of equipment used. It is also difficult to obtain uniform deposition over the entire surface area of the metal so that after the hydrocarbon solvent has evaporated, discontinuities may be present in the waxy protective film. Areas which are deficient or totally devoid of the waxy protective coating will, of course, be susceptible to the corrosive action of the acid vapors.

The use of coating oil formulations, such as those of U.S. Pat. No. 3,600,310, which contain waxes or wax-like products can also pose problems in subsequent rolling operations if aqueous rolling oils are employed. These waxy coating materials are removed, at least partially, during rolling and become associated with the aqueous rolling oil. The wax, being incompatible with the aqueous system, results in emulsion instability, application problems and other associated difficulties, particularly as the amount of wax in the aqueous rolling oil increases in the system upon recirculation. The resulting wax buildup will coat equipment, clog nozzles and give heavy localized wax deposits on the metal which can result in undesirable carbonaceous deposits if the metal is subjected to heat treatment or annealing.

Slushing oil or rust inhibiting compositions are disclosed in U.S. Pat. No. 3,857,789 which are comprised of a Group IIA, IIIA or IVA metal salt of a mahogany or naphthalene sulfonic acid, an aliphatic carboxylic acid, a cosolvent selected from aromatic hydrocarbons, methyl pyrrolidone, tetrahydrofuran, and mono and dialkyl ethers of alkylene glycols and mixtures thereof, and a paraffinic or naphthenic lubricating oil. Whereas these compositions are effective for preventing corrosion of iron objects, the use of costly aromatic or heterocyclic cosolvents is necessary if homogeneous solutions, which do not separate upon standing, are to be obtained.

SUMMARY OF THE INVENTION

In accordance with the present invention, there is now provided improved coating oil compositions which do not utilize wax esters and which do not require the use of cosolvents to obtain stable homogeneous solutions. It has also quite unexpectedly been discovered that improved paint adhesion is obtained when the coating oil compositions of this invention, which are comprised of a Group IA petroleum sulfonate, a polymeric fatty acid and a low viscosity hydrocarbon oil or hydrocarbon oil blend, are employed.

The present compositions are extremely useful for coating ferrous and non-ferrous metals and effectively protect the metal from the corrosive action of acidic vapors and moisture during storage. Additionally, they lubricate the metal and protect the surface from scratching during coiling and uncoiling operations. Still another advantage of the instant coating oils is the fact that they do not contain waxy materials or require the use of expensive organic solvents.

Oil-soluble alkali metal petroleum sulfonates, natural or synthetic, are used for the formulation of the protective compositions and constitute from 1 to about 15 weight percent of the coating oil. A polymeric fatty acid is also present in an amount from about 1 to 15 weight percent of the overall coating oil composition. Useful polymeric fatty acids typically are those obtained from the polymerization of $C_{18}$ unsaturated fatty acids and contain at least 60% $C_{36}$ dibasic acid. Hydrocarbon oils employed with the alkali metal petroleum sulfonate and polymeric fatty acid are low viscosity naphthenic or paraffinic hydrocarbons. The viscosity (100° F. kinematic) of these hydrocarbons can range from 0.5 to 6 centistokes but more usually is between 1 and 5 centistokes. Naphthenic and paraffinic mineral oils which are essentially wax-free are particularly useful for this purpose. The hydrocarbon oil comprises 70 to 98 percent by weight of the coating oil. Most generally, the combined alkali metal petroleum sulfonate and polymeric fatty acid constitute at least 5 weight percent and does not exceed about 20 weight percent of the coating oil. The resulting coating oils have viscosities (100° F. kinematic) of less than 8 and, more preferably, less than 6 centistokes. Quite unexpectedly, when a Group IA metal petroleum sulfonate is utilized with a polymeric fatty acid and the low viscosity hydrocarbon, an aromatic or heterocyclic cosolvent is not required and metals treated with the coating oils exhibit superior paint adhesion.

DETAILED DESCRIPTION

Petroleum sulfonates useful for the present invention are the oil-soluble Group IA alkali metal sulfonates derived from petroleum fractions or their synthetic substitutes obtained by any of the known manufacturing procedures and which are commercially available from a variety of manufacturers. The molecular weight and the nature of the hydrocarbon and cation portions of the molecule can be varied and are primarily governed by the requirements of the particular application and compatibility considerations, i.e. solubility in the hydrocarbon medium of choice and compatibility with the polymeric fatty acid. Typical oil-soluble petroleum sulfonates correspond to the generic formula $C_nH_{2n-10}SO_3$ Me where Me represents the alkali metal, most usually lithium, sodium, or potassium and n is an integer greater than 20. Sodium petroleum sulfonates are particularly useful. Sodium petroleum sulfonates are commercially available and obtained as solutions in hydrocarbon oils and typically contain 50–80% of the active ingredient.

Necessarily present with the alkali metal petroleum sulfonate is a polymeric fatty acid. I have quite unexpectedly found that, while both products are recognized rust preventatives, effective protection against the corrosive action of acid vapors and the other attendant advantages are obtained only if both materials are present in the prescribed concentration ranges and utilized with a low viscosity hydrocarbon oil or hydrocarbon oil blend.

Polymeric fatty acids are well known and are obtainable from commercial suppliers. These products and processes for their preparation are described extensively in the literature. Typically they are obtained by polymerizing unsaturated monocarboxylic acids containing from 16 to 20 carbon atoms. Depending on the conditions employed dimer, trimer and higher polymer acids are obtained, however, for the purpose of this invention the polymeric acids will contain at least 60 percent by weight dibasic (dimer) acid which is preferably a $C_{36}$ dimer acid obtained by the dimerization of $C_{18}$ fatty acids such as oleic acid, linoleic acid or mixtures thereof. Particularly useful are polymeric fatty acids having 75% or more $C_{36}$ dibasic acid. The remainder of the polymeric fatty acid consists primarily of $C_{54}$ trimer acid and higher oligomers. Small amounts of unreacted monomer, i.e. monocarboxylic acid, may also be present. In addition to the prescribed $C_{36}$ dimer acid content, useful polymeric fatty acids for this invention have acid values and saponification values in the range 180 to 215.

The alkali metal petroleum sulfonate and polymeric fatty acid are combined with a hydrocarbon diluent or carrier which facilitates application to the metal and also imparts useful lubrication properties. Useful hydrocarbon oils for this purpose are any of the commonly used naphthenic, paraffinic or synthetic oils which are substantially inert, substantially wax-free and relatively volatile and which have 100° F. kinematic viscosities from about 0.5 to 6 centistokes. Whereas the foregoing viscosity data is determined in accordance with the kinematic method, primarily due to the low viscosity of the hydrocarbon oil which are utilized for the invention, it will be understood that this data can be readily converted to other viscometric units, such as Saybolt Universal Seconds (SUS), by referring to available conversion tables. One such chart for determining equivalent viscosities at 100° F. is found at page 36 of "The Lubrication Manual", First Edition (1971), published by the United States Steel Corporation. Thus, by way of example, the upper viscosity limit of the hydrocarbon oil used for the preparation of the present improved coating oil compositions, represented in SUS units, is approximately 46.

The viscosity of the hydrocarbon(s) to be used is dictated primarily by the method of application, i.e. whether the coating oil is sprayed, wiped, rolled or brushed onto the surface of the metal, whether the metal is immersed in a bath containing the oil, etc. Hydrocarbon oils with kinematic viscosities in the range 1 to 5 centistokes at 100° F. are most useful for most applications and are therefore particularly advantageous. By judicious blending it is possible to employ a hydrocarbon having a viscosity greater than 5 centistokes so long as the viscosity of the resulting hydrocarbon blend is within the ranges prescribed above.

By the terms "substantially inert" and "substantially wax-free" is meant that the hydrocarbon oil does not chemically react with the metal surface or otherwise impair the efficiency of the active components and the wax content of the oil is such that it will not interfere with aqueous rolling oil formulas which might subsequently be used for rolling the coated metal. The term "relatively volatile" indicates that the oil has a vapor pressure such that it can evaporate under ambient conditions leaving a protective coating of the polymeric fatty acid and petroleum sulfonate on the surface of the metal.

Commonly available paraffinic oils and petroleum naphthas having suitable viscosities and useful for the preparation of the present improved coating oils include kerosene, No. 2 fuel oil, Stoddard solvent, mineral spirits, mineral seal oil, and the like. Especially useful hydrocarbons are the solvent extracted "de-waxed" oils which typically have pour points of 10° F. or lower. Synthetic hydrocarbon oils obtained by oligomerizing olefins having up to 20 carbon atoms in the presence of peroxide or Friedel-Crafts catalysts can also be employed. Coating oil compositions exhibiting superior characteristics are obtained using Stoddard solvent or a hydrocarbon oil blend where Stoddard solvent is the major component oil.

As was pointed out previously, it will be understood that mixtures of hydrocarbon oils are equally satisfactory for the practice of this invention, in fact, it is sometimes advantageous to utilize blends of two or more petroleum and/or synthetic hydrocarbons. This is particularly advantageous for the user since he can "customize" the coating oils to fit his particular needs. Also, this feature makes it possible for the supplier to provide a multi-purpose coating oil "concentrate" which can later be diluted to suit the needs of the user. The compositions of this invention are particularly suited for preparation of concentrates since both the polymeric fatty acid and alkali metal petroleum sulfonate are readily soluble in the hydrocarbon oils even at high concentrations.

The polymeric acid and petroleum sulfonate are added, individually or in combination, to the hydrocarbon oil or hydrocarbon oil blend and are readily soluble therein without any special processing. Conventional mixing is sufficient to achieve solution and the resulting solutions are stable and do not deteriorate or separate under ambient conditions even when allowed to stand for prolonged periods. Additives such as stabilizers, fungicides, bacteriocides, and the like may be present in small amounts, however, they are not necessary for most applications.

Useful coating oils will contain from 1 to 15 weight percent of the oil-soluble alkali metal petroleum sulfonate, 1 to 15 weight percent polymeric fatty acid and 70 to 98 weight percent hydrocarbon oil. Particularly useful compositions contain 2 to 12 weight percent sodium petroleum sulfonate, 2 to 10 weight percent polymer acid and 78 to 96 weight percent hydrocarbon oil. The active components (sulfonate and polymer acid) most generally constitute from 5 to 20 weight percent of the coating oil formulations. Especially useful coating oil formulations of this invention have viscosities (100° F. kinematic) of less than 8 centistokes and, more preferably, less than 6 centistokes.

The coating oils of this invention represent a significant improvement over the slushing oils of U.S. Pat. No. 3,857,789. In addition to being low viscosity fluids readily adaptable for application to metal sheet moving on a mill line at high rates of speed, the oils evaporate quickly to form an effective continuous protective barrier over the treated metal surface. Furthermore, this is accomplished without the use of costly aromatic, heterocyclic, or glycol ether solvents as are required for the prior art compositions. Quite unexpectedly, it has also been discovered that metals coated with the present oils, comprised of a low viscosity hydrocarbon, a polymeric fatty acid and monovalent metal petroleum sulfonate, exhibit significantly improved paint adhesion compared to the metals coated with the oils of U.S. Pat. No. 3,857,789.

While the coating oils of this invention are primarily used with ferrous metals, they may also be employed to protect nonferrous metals. This and other aspects of the invention, will be more fully illustrated in the following examples which are not intended to limit the invention. In these examples all parts and percentages are on a weight basis unless otherwise indicated.

Resistance to corrosion is determined by suspending a one inch by one inch steel strip cut from can stock in a loosely covered 600 ml glass beaker containing approximately 100 mls. 5% hydrochloric acid solution, heating the beaker and its contents at 200° F. for 4 hours, removing the strip and allowing to stand exposed to the atmosphere for 16 hours and then visually examining and rating the strip for corrosion. The following ratings are employed: clear (no corrosion), light, moderate and heavy corrosion. The conditions of this test are considered to be much more severe than are normally encountered in active industrial use since the pH of the hot vapors in the beaker is approximately 2. Prior to testing, the steel strips are solvent washed and soaked in dilute hydrochloric acid to remove any protective film applied by the manufacturer and to insure that a fresh clean metal surface is provided for the test. The cleaned steel strips are dipped in the coating oil, suspended and allowed to drain for several hours before being evaluated in the corrosion test.

EXAMPLE I

A series of coating oils were prepared varing the amounts of sodium petroleum sulfonate (Alox® 319FX) and dimer acid (Empol® 1018 Dimer acid containing approximately 83% $C_{36}$ dibasic acid) used. Stoddard solvent (petroleum naphtha; boiling range 315°-334° F.; 100° F. viscosity 1.20 centistokes) was used as the diluent for all the formulations. Each formulation was evaluated for resistance to corrosion and the results were as follows:

| | % Pet. Sulfonate (60% active)/% Dimer/ | % Stoddard Solvent | Coating Oil Viscosity[1] | Corrosion |
|---|---|---|---|---|
| IA | 3/2/95 | | 1.35 | Clear |
| IB | 4/2/94 | | 1.36 | Clear |
| IC | 5/2/93 | | 1.38 | Clear |
| ID | 3/4/93 | | 1.40 | Clear |
| IE | 4/4/92 | | 1.41 | Clear |
| IF | 5/4/92 | | 1.42 | Clear |
| IG | 12/10/78 | | 4.28 | Clear |

[1]100° F. kinematic

To demonstrate the need to have both the petroleum sulfonate and polymeric fatty acid present with the hydrocarbon oil to achieve corrosion resistance, the following formulations were prepared for comparative purposes and gave the following results:

| % Pet. Sulfonate/% Dimer/ | % Stoddard Solvent | Corrosion |
|---|---|---|
| 0/0/100 | | Heavy |
| 0/0.5/99.5 | | Heavy |
| 0/2/98 | | Heavy |
| 0/4/96 | | Heavy |
| 0/12/88 | | Heavy |
| 4/0/96 | | Heavy |
| 12/0/88 | | Heavy |

The above results clearly demonstrate the superior results obtained with the coating oils of this invention and the need for both the polymeric acid and the alkali metal petroleum sulfonate if resistance to the corrosive action of the acid vapors is to be obtained.

In addition to forming an effective continuous protective barrier on the surface of metal treated therewith it was also observed that the surface of the metal was not excessively oily or sticky and that it was not necessary to solvent wash the metal in order to obtain good paint adhesion. To demonstrate this point, 2×8 inch steel Q-panels (SAE 1010 low carbon cold rolled steel, approximate Rockwell B65-70, smooth finish) coated with each of the formulations prepared above (containing dimer and sodium petroleum sulfonate) were air-dried for 24 hours and then spray painted with white enamel (Dutch Boy Spra-Swift). After being allowed to dry for 24 hours, the tenacity of the paint film to the metal surface was tested by firmly applying ¾" wide transparent tape (Scotch ®brand) to the panel. Upon removal of the tape, none of the paint was lifted from the metal with the tape.

EXAMPLE II

Employing the petroleum sulfonate and polymeric fatty acid of Example I in varying amounts, a series of coating oils were prepared using hydrocarbon oil blends comprised of Stoddard solvent and solvent extracted neutral paraffinic hydrocarbon oil (pour point 0° F.; viscosity (100° F.) 31.9 centistokes). The hydrocarbon oil blends utilized all had 100° F. kinematic viscosities below 5 centistokes. The resulting coating oils were applied to steel strips and evaluated for resistance to the corrosive action of HCl vapor. The compositions and results of the corrosion test were as follows:

| | % Pet. Sulfonate (60% active)/% Dimer/ | % Stoddard Solvent / | % Paraffinic Oil | Corrosion |
|---|---|---|---|---|
| IIA | 2/4/69/25 | | | Clear |
| IIB | 12/2/61/25 | | | Clear |
| IIC | 12/4/59/25 | | | Clear |

The viscosity of product IIC, which was the most viscous coating oil of those prepared, was 5.89 centistokes.

Resistance to corrosion is also obtained with the above formulations when metal strips treated with the coating oils are exposed to sulfuric acid vapors under similar test conditions.

Panels coated with the oils also exhibited good paint adhesion when evaluated in accordance with the procedure of Example I. To demonstrate the criticality of the composition and viscosity of the coating oil, formulations were prepared using similar hydrocarbon oils obtained by blending Stoddard solvent with 31.9 CSt paraffinic oil. The viscosity of the hydrocarbon carrier oil was, in all instances, less than 5 centistokes. Compositions and coating oil viscosities were as follows:

| % Sulfonate/ | % Dimer/ | % Stoddard Solvent / | % Paraffinic Oil | Coating Oil Viscosity (centistokes) |
|---|---|---|---|---|
| | | 24/12/39/25 | | 19.9 |
| | | 12/24/39/25 | | 17.5 |
| | | 24/4/47/25 | | 8.6 |

Whereas all of these products provided effective corrosion resistance when applied to the metal, paint adhesion to the treated surfaces was unacceptable. With each of the latter coating oils, paint in contact with the transparent tape was lifted when the tape was removed from the painted surface.

EXAMPLE III

Following the procedure of Example II, a coating oil was prepared except that in this instance the polymeric fatty acid used contained 92% $C_{36}$ dimer acid. The coating oil contained 12% sodium petroleum sulfonate (60% active), 4% dimer, 59% Stoddard solvent and 25% of the solvent extracted neutral paraffinic oil. The hydrocarbon oil (Stoddard solvent and paraffinic oil) blend had a viscosity of 3.3 centistokes and the viscosity of the resulting coating oil was less than 7 centistokes. The coating oil provided excellent protection for the steel strip in the corrosion test and there was no evidence of corrosion at the conclusion of the test period. Metal panels treated with the coating oil gave good paint adhesion.

EXAMPLE IV

To demonstrate the ability of the coating oils to be used with non-ferrous metals, aluminum strips were coated with a coating oil having a 100° F. viscosity less than 7 centistokes and comprised of 12% sodium petroleum sulfonate (60% active), 4% dimer acid containing 83% $C_{36}$ dimer acids, 6% naphthenic bright stock, 25% solvent extracted neutral paraffinic oil and 53% petroleum naphtha. The viscosity (100° F.) of the hydrocarbon oil (without the petroleum sulfonate and dimer acid) was less than 5 centistokes. Coated aluminum strip was subjected to the corrosion test and compared with an untreated aluminum strip. Whereas the untreated control was slightly etched and had a dull, discolored finish, the treated aluminum strip remained bright with no evidence of discoloration or any change in appearance.

EXAMPLE V

The coating oil of Example IV was applied to a clean brass bar which was exposed to the corrosive action of HCl vapors in accordance with the test procedure. The treated bar was unchanged in appearance after the test period—it remained bright and there was no discoloration. An untreated control was slightly etched and the surface was dull and discolored.

EXAMPLE VI

To further demonstrate the invention and the improved results obtained therewith, two coating oils containing 12% sodium petroleum sulfonate (60% active) and 4% dimer acid were prepared. The petroleum sulfonate and dimer were the same as used in Example I. The remainder of the formulation for the first coating oil composition consisted of 6% naphthenic bright stock and 78% paraffinic petroleum oil (150 SUS) and for the second formulation consisted of 6% naphthenic bright stock and 78% Stoddard solvent. The viscosities of the resulting coating oil formulations were significantly different, 64.5 centistokes and 2.86 centistokes, respectively. Both coating oils provided excellent resistance to corrosion when steel strips treated with these coating oils were subjected to the corrosive action of HCl in accordance with the test procedure, however, acceptable paint adhesion was obtained only with the 2.86 centistoke coating oil. The paint applied to metal panels coated with the 64.5 centistoke product pulled off the metal surface when the tape was removed.

EXAMPLE VII

A highly effective coating oil was prepared in accordance with the following formulation:

4 Parts dimer acid (83% $C_{36}$ dibasic acid)
12 Parts sodium petroleum sulfonate (60% active)
6 Parts naphthenic bright stock
25 Parts paraffinic oil (32 centistokes at 100° F.)
53 Parts petroleum naphtha (1.2–1.4 centistokes at 100° F.)

The viscosity of the combined hydrocarbon oils was 2.63 centistokes and the resulting coating oil had a viscosity of 5.11 centistokes. Steel strip treated with the coating oil composition showed no evidence of corrosion when subjected to the corrosion test. The coating oil also provided an effective protective barrier for aluminum, copper and brass.

The coating oil was sprayed on the surface of steel sheet moving at a high rate of speed (8 to 10 ft. per second) and provided a highly effective corrosion resistant protective coating over the entire surface of the metal. Coils of the coated steel sheet stored in the mill for an extended period under adverse conditions (high humidity and high concentration of acidic vapors), showed no evidence of corrosion. Upon uncoiling, the surface of the metal was bright, free of discoloration, rust and pitting.

A spray mist of the coating oil was similarly applied to cold rolled low carbon steel sheet (26" wide) and coils of the treated sheet stored outdoors (uncovered) for 45 days. When the sheet was uncoiled there was no evidence of corrosion. The sheet was then passed through a lead bath and into a slitter where it was cut into narrow bands. The metal banding had good surface qualities and uniformly accepted paint without difficulty.

EXAMPLE VIII

To demonstrate the need for the polymeric fatty acid with the alkali metal sulfonate for the compositions of this invention, oleic acid was substituted for the polymeric fatty acid in Product IA. Whereas the viscosity of the resulting coating oil containing the oleic acid was essentially the same as that of product IA, heavy rusting and corrosion was obtained with metal coated with the oleic-containing product. Similarly, when linoleic acid, ricinoleic acid or stearic acid was combined with sodium petroleum sulfonate in Stoddard solvent, heavy corrosion was observed upon exposure of the treated metal to the acid atmosphere.

EXAMPLE IX

To illustrate the necessity of employing an alkali metal, i.e. monovalent metal, petroleum sulfonate for the coating oils of this invention, a coating oil was prepared for comparative purposes utilizing a synthetic petroleum sulfonate of a divalent metal. For this coating oil formulation synthetic barium dinonyl-naphthalene sulfonate (NA-SUL® BSN) was substituted for the sodium sulfonate in Product IIC. Whereas it was possible to obtain a substantially homogeneous coating oil solution when the product was stirred at 150° F., noticeable phase separation of the components was evident within a very short time when the oil was allowed to stand at room temperature. In order to obtain a homogeneous solution, which did not separate upon standing at ambient conditions using the divalent metal sulfonate, required the addition of several parts of a cosolvent of the type employed for the compositions of U.S. Pat. No. 3,857,789.

EXAMPLE X

To further demonstrate the advantages of the coating oils of this invention over the compositions of U.S. Pat. No. 3,857,789 the formulations A-C were prepared as follows:

| | Weight Percent | | |
|---|---|---|---|
| | A | B | C |
| Sodium Petroleum Sulfonate | 4 | — | — |
| Barium Petroleum Sulfonate | — | 4 | 4 |
| Dimer Acid | 2 | 2 | 2 |
| Butyl Cellosolve | — | — | 3 |
| Stoddard Solvent[1] | 94 | — | — |
| Pale Oil (100 SUS)[2] | — | 94 | 91 |

[1]100° F. kinematic viscosity 1.3 centistokes
[2]100° F. kinematic viscosity 20.3 centistokes Product A, a coating oil prepared in accordance with this invention, was a homogeneous yellow liquid (100° F kinematic viscosity 1.52 centistokes) which did not separate upon standing at ambient conditions for up to three months. Product B, prepared using a divalent metal sulfonate in accordance with U.S. Pat. No. 3,857,789, but without a cosolvent, produced an incompatible system. Due to the separation of phases product B could not be utilized for subsequent testing. Product C, prepared following the teachings of U.S. Pat. No. 3,857,789, gave a homogeneous amber solution having a 100° kinematic viscosity of 31.5 centistokes (148 SUS). Products A and C were uniformly applied to both sides of $6\frac{3}{4}\times3$ inch steel panels. The panel coated with product A was essentially dry to the touch with no undesirable oily sticky film after 15 minutes whereas the panel coated with product C had an oily residue even after drying for 24 hours. After 24 hours the panels coated with Product A retained 5.2% of the weight of the original oil applied whereas panels coated with Product C retained 29% of the original weight of applied oil. In spite of the face that amount of the protective residue on the metal was approximately five times less with Product A versus Product C, no rust or corrosion was observed on the panels coated with Product A when they were exposed to the acid corrosion test. Panels coated with both products were spray painted after being allowed to dry for up to five days with the following results:

| Drying Time | Product A | Product C |
|---|---|---|
| 1 day | no peeling | heavy peeling |
| 2 days | no peeling | heavy peeling |
| 5 days | no peeling | heavy peeling |

When sodium petroleum sulfonate was substituted for barium sulfonate in the preparation of Product C, there was no appreciable improvement in the paint adhesion of panels coated therewith.

I claim:

1. A coating oil composition consisting of (a) 1 to 15% polymeric fatty acid obtained from the polymerization of unsaturated $C_{16-20}$ monocarboxylic acids and and containing at least 60% $C_{36}$ dimer acid, (b) 1 to 15% oil-soluble Group IA alkali metal petroleum sulfonate and (c) 70 to 98% inert and substantially wax-free naphthenic or paraffinic hydrocarbon oil having a 100° F. kinematic viscosity from 0.5 to 6 centistokes.

2. The coating oil of claim 1 wherein the Group IA alkali metal petroleum sulfonate is a sodium petroleum sulfonate.

3. The coating oil of claim 1 wherein the polymeric fatty acid contains 75% or more $C_{36}$ dimer acid and has an acid value of 180 to 215 and saponification value of 180 to 215.

4. The coating oil of claim 1 containing 2 to 10% polymeric fatty acid, 2 to 12% sodium petroleum sulfonate and 78 to 96% hydrocarbon oil.

5. The coating oil of claims 2, 3 or 4 wherein the hydrocarbon oil has a 100° F. kinematic viscosity of 1 to 5 centistokes and the viscosity (100° F. kinematic) of the coating oil is less than 8 centistokes.

6. The coating oil of claim 5 wherein the hydrocarbon oil is Stoddard solvent or a blend of hydrocarbon oils wherein Stoddard solvent is the major component oil.

7. A method of protecting a metal surface which comprises treating a metal with a coating oil having a 100° F. kinematic viscosity of less than 8 centistokes and consisting of (a) 1 to 15% polymeric fatty acid obtained from the polymerization of unsaturated $C_{16-20}$ monocarboxylic acids and containing at least 60% $C_{36}$ dimer acid, (b) 1 to 15% oil-soluble Group IA alkali metal petroleum sulfonate and (c) 70 to 98% inert and substantially wax-free naphthenic or paraffinic hydrocarbon oil having a 100° F. kinematic viscosity of 0.5 to 6 centistokes so as to obtain a continuous protective coating on the exposed metal surfaces.

8. The method of claim 7 wherein the Group IA alkali metal petroleum sulfonate is a sodium petroleum sulfonate.

9. The method of claim 8 wherein the hydrocarbon oil is Stoddard solvent or a hydrocarbon blend wherein Stoddard solvent is the major component oil and substantially all of said hydrocarbon oil is evaporated.

10. The method of claim 9 wherein the coating oil is applied to rolled metal sheet.

11. The method of claim 10 wherein the coating oil is sprayed on the metal surface.

12. A metal article having applied to its surface a coating oil consisting of (a) 1 to 15% polymeric fatty acid obtained from the polymerization of unsaturated $C_{16-20}$ monocarboxylic acids and containing at least 60% $C_{36}$ dimer acid, (b) 1 to 15% oil-soluble Group IA alkali metal petroleum sulfonate and (c) 70 to 98% inert and substantially wax-free naphthenic or paraffinic hydrocarbon oil having a 100° F. kinematic viscosity from 0.5 to 6 centistokes.

13. The metal article of claim 12 wherein the hydrocarbon oil is Stoddard solvent or a hydrocarbon oil blend wherein Stoddard solvent is the major component oil and all or a portion of said hydrocarbon oil is evaporated to provide a substantially continuous protective film resistant to moisture and acid vapors.

14. The metal article of claim 13 wherein the Group IA alkali metal petroleum sulfonate is a sodium petroleum sulfonate.

15. The metal article of claim 14 wherein the coating oil contains 2 to 10% polymeric fatty acid containing 75% or more $C_{36}$ dimer acid, 2 to 12% sodium petroleum sulfonate and 78 to 96% hydrocarbon oil.

* * * * *